US005820458A

United States Patent [19]

Lai

[11] Patent Number: 5,820,458

[45] Date of Patent: Oct. 13, 1998

[54] VENTILATION DEVICE

[76] Inventor: Bi-Hing Lai, No. 671, San Min Rd., Chun Tu Village, Shen Kang Hsian, Taichung Hsien, Taiwan

[21] Appl. No.: 843,511

[22] Filed: Apr. 16, 1997

[30] Foreign Application Priority Data

Mar. 24, 1997 [TW] Taiwan ..... 86204555

[51] Int. Cl.[6] ..... F24F 7/007

[52] U.S. Cl. ..... 454/354; 415/206

[58] Field of Search ..... 454/341, 349, 454/353, 354; 415/206

[56] References Cited

U.S. PATENT DOCUMENTS

| | | | |
|---|---|---|---|
| 353,994 | 12/1886 | Walker et al. | 415/206 |
| 2,898,841 | 8/1959 | Knutson et al. | 454/353 |
| 4,977,884 | 12/1990 | Kaufman | 454/354 X |

FOREIGN PATENT DOCUMENTS

| | | | |
|---|---|---|---|
| 58-102041 | 6/1983 | Japan | 454/354 |
| 6-147582 | 5/1994 | Japan | 454/354 |
| 6180 | 10/1831 | United Kingdom | 415/206 |
| 479823 | 2/1938 | United Kingdom | 415/206 |
| 609330 | 6/1983 | United Kingdom | 415/206 |

*Primary Examiner*—Harold Joyce
*Attorney, Agent, or Firm*—Browdy and Neimark

[57] ABSTRACT

A ventilation device is composed of an air inlet base, an air guiding box mounted on the air inlet base, and a ventilation fan. The air guiding box is made up of a main body and a motor base mounted on the main body. The ventilation fan is mounted on the shaft of a motor which is in turn mounted on the motor base. The ventilation device is effectively downsized without compromising its ventilation efficiency.

9 Claims, 2 Drawing Sheets

VENTILATION DEVICE

FIELD OF THE INVENTION

The present invention relates generally to a fan, and more particularly to a ventilation fan.

BACKGROUND OF THE INVENTION

As shown in FIG. 1, a ventilation device of the prior art consists of a base 10, a locating frame 13, a motor 14, a fan blade 15, and a cover 16. The base 10 is made up of a plurality of plates by welding and is provided in the bottom thereof with a plurality of punched holes 12 for circulating air. The locating frame 13 is mounted in the base 10. The motor 14 is mounted securely on the locating frame 13. The fan blade 15 is mounted on a shaft of the motor 14 for circulating air. The cover 16 is joined with the open top of the base 10 and is provided at the center thereof with a ventilation hole 17 for circulating air.

Such a prior art ventilation device as described above is defective in design in that the process of making the ventilation device involves excessive welding, and that the discharge of air is brought about radially to result in the deposit of moisture inside the ceiling where the ventilation device is located.

In order to overcome the drawbacks of the prior art ventilation device described above, the inventor of the present invention discloses in the Taiwan Patent No. 82215132 an improved ventilation device, which consists of an air guiding box made integrally with the air admitting base. The air guiding box is provided therein with a loop capable of exhausting air in a predetermined direction. However, this improved ventilation device is also defective in design in that the air guiding box is rather complicated in construction, and that it is therefore not cost-effective, and further that it can not be easily repaired, and still further that its ventilation efficiency is undermined by its air discharging port which is excessively curved.

SUMMARY OF THE INVENTION

The primary objective of the present invention is to provide a ventilation device which can be made at a low cost.

Another objective of the present invention is to provide a ventilation device which can be maintained and repair easily.

There is still another objective of the present invention to provide an improved ventilation device which is quiet and effective in driving out foul air.

In keeping with the principle of the present invention, the foregoing objectives of the present invention are attained by an improved ventilation device, which comprises an air inlet base, an air guiding box, and an air discharging device. The air inlet base is provided at the center thereof with an air inlet which is in turn provided around the fringe thereof with a raised portion. The air guiding box has a bottom edge which is attached to the raised portion such that the air guiding box and the motor base form an air guiding channel. The discharging device consists of a motor and a fan, which are mounted in the air guiding box for driving out the foul air.

The foregoing objectives, features and functions of the present invention will be more readily understood upon a thoughtful deliberation of the following detailed description of a preferred embodiment of the present invention in conjunction with the accompanying drawings.

DETAILED DESCRIPTION OF THE INVENTION

Figure 1:
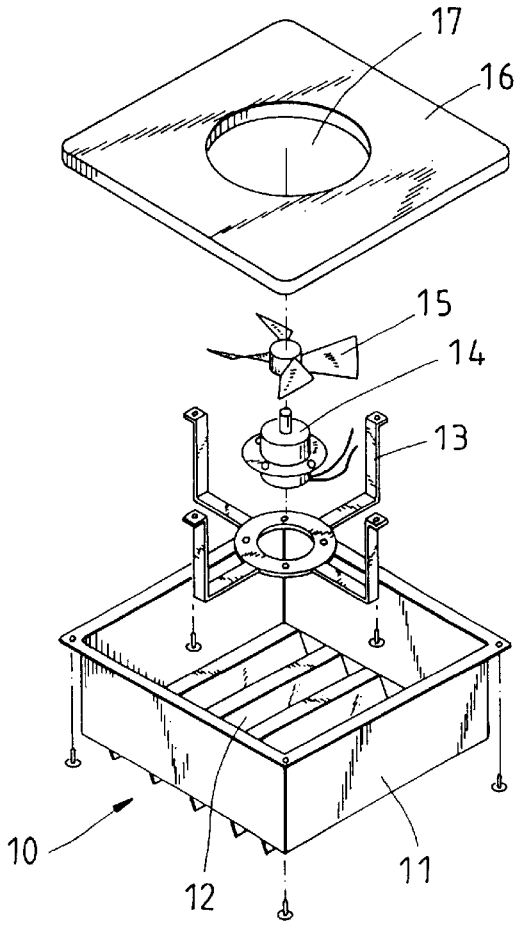
FIG. 1 PRIOR ART
FIG. 1 shows an exploded view of a ventilation device of the prior art.
Figure 4:
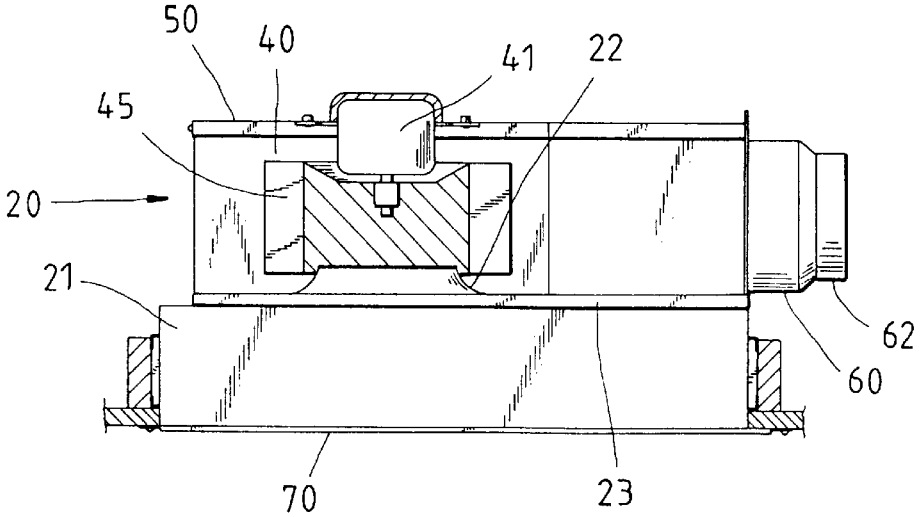
FIG. 4 shows a sectional view of the present invention in combination.
Figure 2:
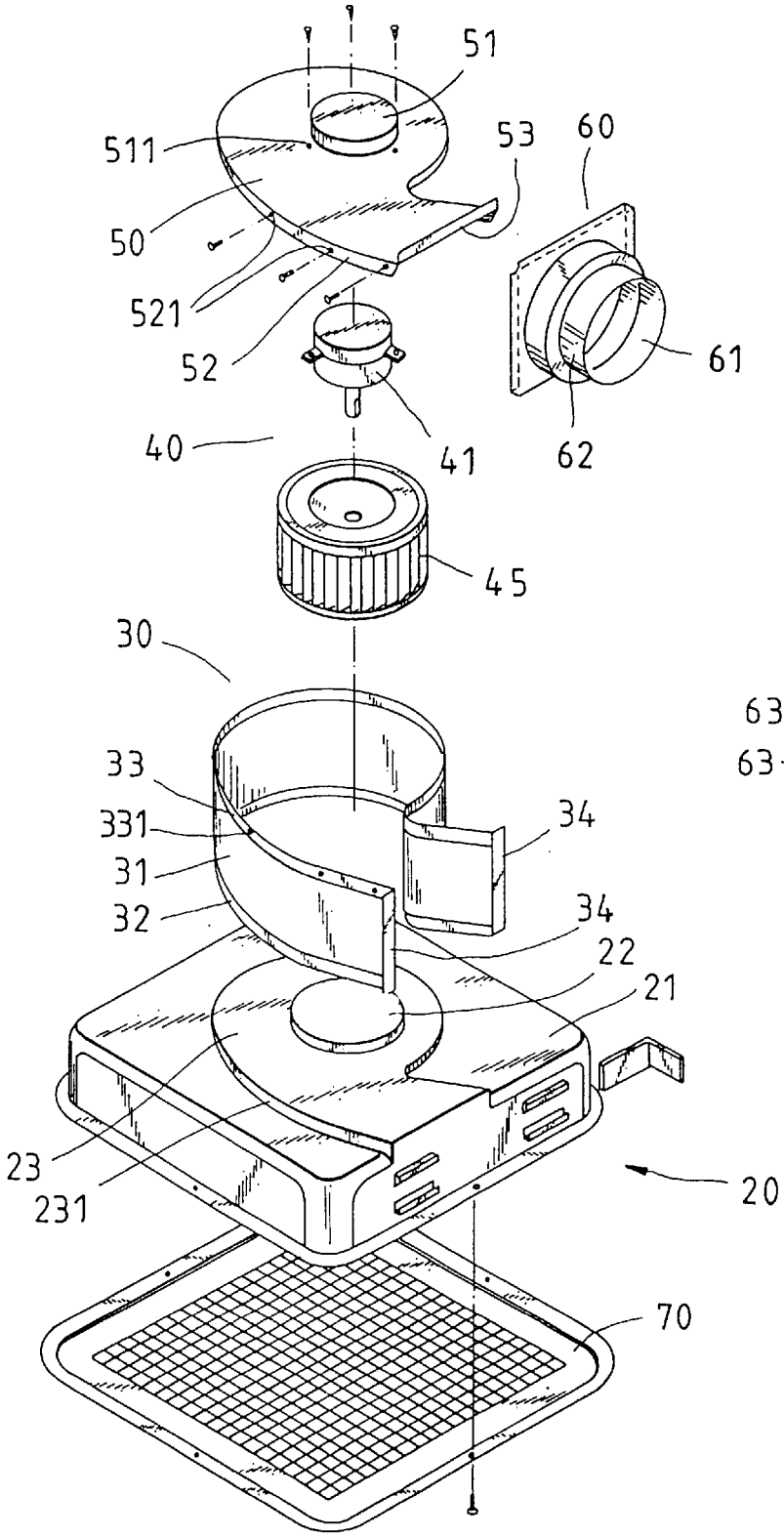
FIG. 2 shows an exploded view of a ventilation device of the present invention.
Figure 3:
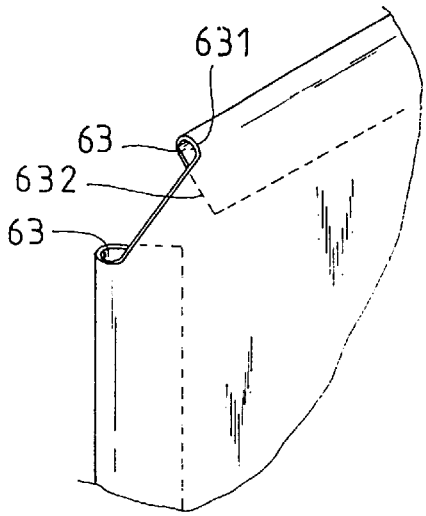
FIG. 3 shows an enlarged view of a hooked edge of the cover of the ventilation device of the present invention.

As shown in FIGS. 2–4, a ventilation device 20 embodied in the present invention is composed of the component parts, which are described explicitly hereinafter.

An air inlet base 21 is mounted in an appropriate place of the ceiling of a room, such as a bath room. The air inlet base 21 is provided at the center thereof with an air inlet 22 formed by punching. The air inlet 22 is provided around the fringe of the top thereof with a P-shaped raised portion 23 which is made integrally with the air inlet base 21.

An air guiding box 30 is made up of a main body 31 and a motor base 50 mounted on the main body 31. The main body 31 is similar in profile to the raised portion 23 and is made of a metal material. The air guiding box 30 has a bottom edge 32, which is fastened to the outside of the raised portion 23 of the air inlet base 21 such that the inner side of the bottom edge 32 is attached securely to the side 231 of the raised portion 23 for forming a loop for circulating the air. The top edge 33 of the air guiding box 30 is provided with a plurality of horizontal through holes 331. The front edges are provided respectively with two retaining portions 34.

An air ventilation fan 40 is composed of a motor 41 and a fan 45.

A motor base 50 is similar in profile to the raised portion 23 and is mounted on the main body 31 of the air guiding box 30. The motor base 50 is provided with a motor receiving chamber 51 opposite in location to the air inlet 22 of the air inlet base 21. The chamber 51 is provided with a plurality of motor fastening holes 511. The periphery 52 of the motor base 50 is fastened with the top edge 33 of the main body 31. The periphery 52 of the motor base 50 is provided with a plurality of through holes 521 opposite to the through holes 331 for fastening the motor base 50 with the main body 31 by means of a plurality of screws. The motor base 50 is provided at the front edge thereof with an upper retaining portion 53.

A ventilation cover 60 is provided at the center thereof with a ventilation hole 61 for discharging air from the air guiding box 30. The ventilation hole 61 is provided with a fitting portion 62. The cover 60 is provided with three hooked edges 63 having a short portion 631 which is in turn provided with a folded portion 632. The cover 60 is joined with the main body 31 and the motor base 50 such that the hooked edges 63 are engaged with the retaining portions 34 of the main body 31 and the upper retaining portion 53 of the motor base 50.

An inlet cover 70 is fastened with the bottom of the air inlet base 21.

In combination, the main body 31 is fastened with the air inlet base 21. The ventilation device 40 is mounted on the top of the main body 31. The inlet cover 70 is joined with the air inlet base 21.

The present invention is relatively simple in construction in that the main body 31 of the air guiding box 31 and the motor base 50 can be located easily and quickly, and that the ventilation cover 60 and the motor base 50 of the present invention can be easily dismounted to facilitate the maintenance work of the ventilation device 40 and the main body 31 of the air guiding box 30. In addition, the air discharging port of the air guiding box 30 of the present invention is so designed that the back flow of air is averted effectively. Moreover, the ventilation cover 60 of the present invention is provided with the fitting portion 62, which can be connected with an air exhausting pipe to facilitate the exhausting of foul air.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A ventilation device comprising:

an air inlet base provided with an air inlet having a raised portion (23) extending above a top side of said air inlet base;

an air guiding box composed of a main body and a motor base, with a bottom edge (32) of said main body being mounted on said air inlet base by attaching said bottom edge to said raised portion of said air inlet base, said motor base being mounted on a top edge (33) of said main body; and a ventilation fan composed of a motor mounted on and below said motor base of said air guiding box and above an air inlet in said air inlet base, and a fan blade mounted on a shaft of said motor.

2. The ventilation device as defined in claim 1, wherein said raised portion of said air inlet base has a P-shaped profile.

3. The ventilation device as defined in claim 1, wherein the top edge (33) of said main body of said air guiding box is provided with a plurality of fastening holes; wherein said motor base of said air guiding box is provided with a plurality of fastening holes; and wherein said motor base is securely mounted on said main body by a plurality of fastening screws engaging said fastening holes of said main body and said motor base.

4. The ventilation device as defined in claim 1, wherein said main body of said air guiding box is provided with two retaining portions, wherein said motor base of said air guiding box is provided with a retaining portion, the ventilation device further comprising a cover provided with an air outlet and fastened with said motor base of said air guiding box.

5. The ventilation device as defined in claim 4, wherein said cover is provided with a plurality of retaining portions which are respectively engaged securely with said two retaining portions of said main body and said retaining portion of said motor base of said air guiding box.

6. A ventilation device comprising:

an air inlet base provided with an air inlet having a raised portion (23) extending above a top side of said air inlet base;

an air guiding box composed of a main body and a motor base, with a bottom edge (32) of said main body being mounted on said air inlet base by attaching said bottom edge to said raised portion of said air inlet base, said motor base being mounted on a top edge (33) of said main body; and a ventilation fan composed of a motor mounted on and below said motor base of said air guiding box and above an air inlet in said air inlet base, and a fan blade mounted on a shaft of said motor, wherein said raised portion of said air inlet base has a P-shaped profile.

7. The ventilation device as defined in claim 6, wherein the top edge (33) of said main body of said air guiding box is provided with a plurality of fastening holes; wherein said motor base of said air guiding box is provided with a plurality of fastening holes; and wherein said motor base is securely mounted on said main body by a plurality of fastening screws engaging said fastening holes of said main body and said motor base.

8. The ventilation device as defined in claim 6, wherein said main body of said air guiding box is provided with two retaining portions, wherein said motor base of said air guiding box is provided with a retaining portion, the ventilation device further comprising a cover provided with an air outlet and fastened with said motor base of said air guiding box.

9. The ventilation device as defined in claim 8, wherein said cover is provided with a plurality of retaining portions which are respectively engaged securely with said two retaining portions of said main body and said retaining portion of said motor base of said air guiding box.

* * * * *